United States Patent [19]

Turnbull et al.

[11] 4,294,021

[45] Oct. 13, 1981

[54] METHOD AND APPARATUS FOR CURING OF ARTICLES

[75] Inventors: James O. Turnbull; John C. Barker, both of Cowansville; Arthur J. Knight, Bromont, all of Canada

[73] Assignee: J. J. Barker Company Limited, Cowansville, Canada

[21] Appl. No.: 27,914

[22] Filed: Apr. 5, 1979

[51] Int. Cl.[3] ..... F26B 15/12

[52] U.S. Cl. ..... 34/224; 34/36; 34/232; 118/58

[58] Field of Search ..... 34/36, 37, 155, 223, 34/224, 227, 232, 233; 118/64, 61, 65, 58

[56] References Cited

U.S. PATENT DOCUMENTS 1,186,477 6/1916 Grosvenor ..... 34/36
2,810,662 10/1957 Barnebey ..... 118/68
3,509,638 5/1970 MacLeod ..... 34/155
3,851,402 12/1974 Turnbull et al. ..... 34/47

*Primary Examiner*—Larry I. Schwartz
*Attorney, Agent, or Firm*—Schwartz, Jeffery, Schwaab, Mack, Blumenthal & Koch

[57] ABSTRACT

A method and apparatus for curing of wet resin-coated articles in a curing chamber by means of a vaporous curing agent. The vaporous curing agent is circulated through distribution members having nozzles or openings which are adapted to disperse the curing agent in an angular direction cocurrent with the direction of travel of the articles being passed through the curing chamber. The exhaust is provided near the exit end, and thus a gaseous flow is induced from the inlet through the chamber to the exhaust thereby minimizing the escape of vaporous curing agent through the inlet opening.

6 Claims, 4 Drawing Figures

METHOD AND APPARATUS FOR CURING OF ARTICLES

BACKGROUND OF THE INVENTION

1. Field of the Invention

This invention relates to a method and apparatus for curing of articles, and more particularly, this invention relates to a method and apparatus for contacting wet resin-coated articles with a curing agent in a curing chamber for curing of the resin coating.

2. Description of the Prior Art

Resin-coated articles, such as panels, can be cured by passing the wet resin-coated articles through various heat treatment stages. Alternatively, radiation or electron beam and ultraviolet ray systems have been proposed. When heat treatment is employed, the materials or substrates which react to heat will be affected, while in the case of the radiation type of curing, the curing is restricted to the specific area of the path of the beam employed. Such systems, in general, are not desirable since they present considerable safety hazards which need to be avoided by expensive safety precautions and these add to the considerable inherent costs of such known systems.

It is also known, as disclosed, for example, in U.S. Pat. No. 3,411,940, Lopez et al, issued Nov. 19, 1968, to use a tertiary amine in a particular solution as curing agent or catalyst. Curing agents, such as tertiary amines, are very effective, usually providing for curing when in the vapor phase in a few seconds of exposure to the item that is to be cured. However, the handling of these vaporous curing agents presents considerable problems since the vapor is highly toxic and use of these vapors must be strictly confined to curing.

In U.S. Pat. No. 3,931,684, Turnbull et al, issued Jan. 13, 1976, there is disclosed an apparatus for curing of articles by means of a tertiary amine curing agent. In accordance with the proposal by Turnbull et al, a curing chamber is provided, which chamber comprises entry and exit ports which are guarded by air curtain means to prevent escape of the toxic gases from the chamber. The air curtain means are connected by communication means, and a controlled heated moist vapor is supplied to the air curtains to substantially reduce or prevent the escape of the volatile gases from within the curing chamber.

The proposal of the Turnbull et al patent has met commercial acceptance, and thus is satisfactory for the containment of the volatile, toxic gases used in such curing operations. However, there is still a need to provide a curing method and apparatus which will yield an improvement in the performance of such curing systems while, concomitantly, being less costly and which at least equal, or exceed, the effectiveness of safety provisions of the prior art systems.

SUMMARY OF THE INVENTION

It is an object of the present invention to provide an apparatus for curing of wet resin-coated articles passing therethrough which is adapted to disperse the vaporous curing agent more effectively than the prior art apparatus.

It is also an object of the present invention to provide a method of curing of wet resin-coated articles, which method is particularly effective in completing the curing operation.

In accordance with the present invention, there is provided an apparatus for curing wet resin-coated articles, comprising a longitudinal, substantially horizontal curing chamber having an inlet end and an exit end and means for transporting articles through the chamber in a continuous motion from said inlet end towards said exit end, a plurality of vapor distribution members having openings, said distribution members extending transversely with respect to the direction of travel of the articles through the curing chamber and in communication with the at least one vapor supply duct, exhaust means including means for creating a negative pressure disposed near the exit end of said chamber for withdrawing spent gases and excess vaporous curing agent from the curing chamber.

In accordance with a preferred embodiment of the present invention, negative pressure means is associated with the exhaust means. The movement of the articles from the inlet to the outlet of the chamber creates a flow of the gases and air towards the exit while the negative pressure means associated with the exhaust means diverts the flow from the exit through the exhaust means adjacent the exit and causes a slight cocurrent flow of air in through the exit means to the exhaust means. The flow of gases in the chamber towards the exit induces a slight amount of air to enter through the inlet means, thereby minimizing the chances of the gases including the vaporous curing agent from escaping to the atmosphere through the inlet opening and the exit opening.

In accordance with a preferred embodiment, the distribution members are adapted to disperse the vaporous curing agent in cocurrent direction with respect to the direction of travel of the articles and at an angle of from about 0° to 45° with respect to the vertical axis of a distribution member. Angular dispersal of the vaporous curing agent is beneficial in achieving a uniform contacting of the wet resin-coated articles with the vaporous curing agent, thus enhancing the known efficiency of vaporous curing agents, such as tertiary amines. The angular disposal of the distribution members with the openings through which the vaporous curing agent is dispensed, in a direction cocurrent with the travel of the articles, enhances the flow towards the exit end of the chamber and through the exhaust means.

Also in accordance with the present invention, there is provided in an apparatus for curing of articles passing therethrough: means for circulating a predetermined volume of gaseous curing agent, said means including a pair of spaced-apart longitudinal supply duct means, one on either side of the chamber, and a plurality of distribution members extending between the supply duct members and in alternating communication with the supply duct members for dispensing vaporous curing agent such that the vaporous curing agent contacts the articles for curing thereof.

Preferably, the balance of the curing agent is passed in a direction towards the exit end of the curing chamber through the supply duct means, but only for a distance approximately equal to the length of the opening of said inlet duct of said fan means.

In accordance with the present invention, there is also provided a method of curing wet resin-coated articles in a curing chamber by means of a vaporous curing agent, said method comprising the steps of advancing an article to be cured through the curing chamber from an inlet end thereof to an exit end thereof, dispersing a vaporous curing agent in said chamber to contact the wet resin-coated articles for curing thereof, and causing a negative pressure in the exhaust near the exit of the chamber to thereby induce and enhance a flow of gas and air from the inlet and outlet openings to the exhaust.

According to one preferred mode of operation of the method in accordance with the present invention, the vaporous curing agent is dispersed at a pressure of about 2.0 p.s.i. A pressure below this value will normally not be sufficient to effectively contact the wet resin-coated articles, thus leading to an undesirable quantity of excess vaporous curing agent, while a pressure greater than 2.0 p.s.i. will tend to cause uneven surface phenomena on the articles which are not desirable.

The invention provides for a number of important advantages. Thus, the containment of the usually toxic curing agent is achieved by simple, yet effective, means without the need for particular precautionary measures near the exit and inlet ends of the curing chambers. Full utilization is provided of all of the vaporous curing agent since any excess thereof is moved in circulatory movement by the fan means, for example. The angular dispersal of the majority of the vaporous curing agent enhances the flow pattern as well as the distribution of the vaporous curing agent on the articles. Dispersal of the curing agent is substantially enhanced by the alternating distribution thereof from the supply duct means to the distribution members.

BRIEF DESCRIPTION OF THE DRAWINGS

The foregoing and other objects and advantages of the invention will appear more clearly from the following specification in connection with the accompanying drawings in which.

DESCRIPTION OF THE PREFERRED EMBODIMENTS

Figure 1:
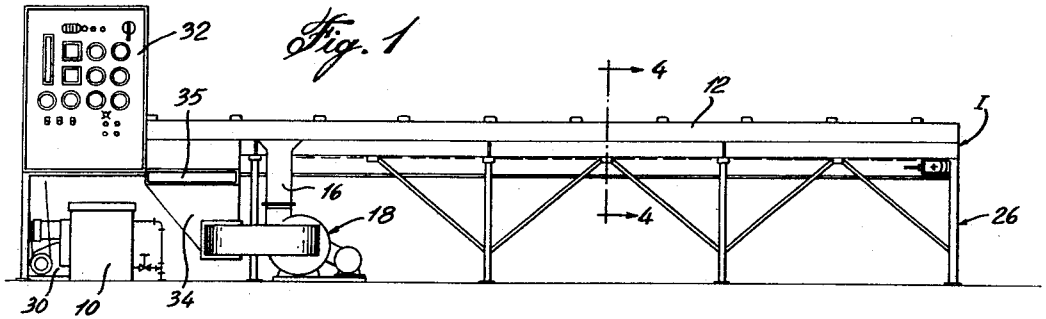
FIG. 1 is a side elevational view of a curing chamber according to one embodiment of the present invention.
Figure 2:
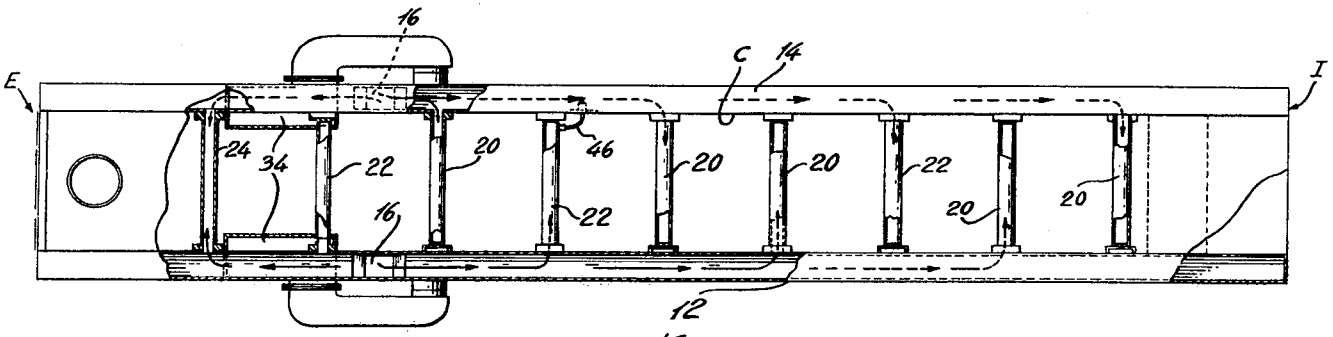
FIG. 2 is a top plan view of part of the curing chamber showing in particular detail the distribution path of the vaporous curing agent.
Figure 4:
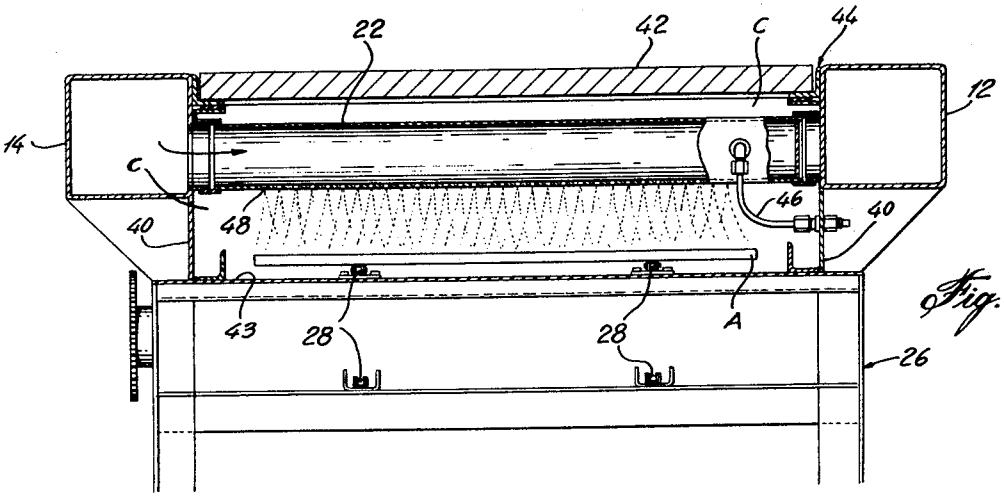
FIG. 4 is a cross-section along line 4–4 in FIG. 1.

Briefly described, with reference to FIG. 1 and FIG. 4, an apparatus embodying the invention comprises a generator, generally designated by the numeral 10, for the provision of a vaporous curing agent, such as, for example, triethyl amine and a suitable inert carrier gas, such as, for example, nitrogen. The vaporous curing agent is passed from the generator 10 to a pair of supply ducts 12 and 14, by means of circulating fans 18 in ducts 16. From the supply ducts 12 and 14, the vaporous curing agent is passed to a plurality of perforated distribution pipes 20, 22 (FIG. 2) extending transversely with respect to the longitudinal axis of the apparatus and between the supply ducts 12 and 14. The ducts 12 and 14 support the distribution pipes 20, 22 and are themselves supported by the frame 26 which also supports a pair of conveyor chains 28 riding on tracks 29 provided on the bottom plate 43 of chamber C powered by a drive 30 and transmission means including sprocket wheels and chains, not shown in detail. Chamber C is laterally closed by side walls 40. A hood 42 is nested in framing 44, and a bottom wall 43 is supported on the frame 26. The hood 42 is a calcium silicate block insulation encapsulated in a mild steel sheeting.

Articles A, for example, panels having a length of 8 feet, a width of 4 feet and a thickness of 0.5 inch, are disposed on the chains 28 to be lengthwise transported thereby from inlet end I to the exit end E of the chamber C on actuation of the required controls, not shown.

Overall control of the system can be provided by a main control panel 32 for setting and monitoring the various parameters of operation.

The chamber C is provided at one end with an opening I which will be referred to as the inlet opening for allowing the articles to pass through the chamber. At the other end of the chamber C is provided an opening E which designates the exit. These openings are only slightly larger than the articles which are adapted to pass therethrough. The whole of the chamber C, including the side walls 40, hood 42 and bottom wall 43, is properly sealed in order to avoid any escape of the vaporous curing agent to the atmosphere.

Venting to the atmosphere from the distribution pipes 20, 22 and 24 is provided for emergencies by a vent tubing 46 secured by standard fittings. Of course, the vent tubing is normally closed by pressure taps, not shown.

An exhaust opening 38 is located adjacent the exit of the chamber. The exhaust conduit 38 communicates with an air lock 36 of well-known construction, whereby a certain percentage of spent gases will be removed from the chamber and either be scrubbed or otherwise cleaned before venting to the atmosphere. Generally speaking, the exhaust takes place through the ducts 34 which communicate with the circulation pump 18 which in turn communicates with the duct 16 which forms a conduit from the pump 18 to the manifold or distribution ducts 12 and 14. In other words, the gas which is being distributed by the pipes 20 and 22 in large proportion is recirculated through the pump 18 through the ducts 12 and 14 and thus to the distribution pipes 20 and 22. The difference is that the supplemental fresh gas which is required to make up for the spent gas being removed from the air lock 36, is supplied by the vapor generator 10.

The ducts 34 are provided with filters 35 through which the gas exhausting from the chamber C is passed. It is noted that the exhaust ducts 34 and the exhaust pipe 38 are near the exit end of the chamber C. It has been noted that when the conveyor chains 28 are moving, carrying articles A which, for example, may be coated panels, a gas flow is created from the inlet to the outlet. In other words, the articles A on the conveyor act somewhat as a pulsating pump, pulling fresh air through the inlet towards the exit. As will be described, the angle of the various distributing pipes 20, that is, the angles of the jets, are in a downstream for the most part and enhance this flow in the direction from the inlet to the outlet. By locating the exhaust ducts 34 and 38 nearer the exit and by creating a slight negative pressure in the exhaust area by means of the circulating fans 18 and the air lock fan 36, for instance, the flow of gases in the chamber will be diverted from the chamber through the exhaust ducts respectively and by locating baffles 50 and 52 on either side of the exhaust 38, the gas flow will tend to go more towards the exhaust ducts rather than through the exit end, and as a matter of fact, the negative pressure created in the ducts causes fresh air to enter through the exit opening. This arrangement reduces the requirement of providing air lock curtains at the inlet and outlet, thereby reducing the overall cost of manufacturing the chamber.

It will be appreciated that the distribution pipes extend between the supply ducts at a height above the chains 28 such that the articles A are fully contacted by the curing agent emerging from the distribution pipes through a plurality of openings or nozzles 48.

The distribution pipes 20, 22 are arranged so as to provide for a very effective and even distribution of the curing agent over the surface of an article A passing thereunder. Thus, the distribution pipe 20 near the inlet end I is in communication with the supply duct 14 but not with the supply duct 12, and the next distribution pipe 22 is in communication with supply duct 12 but not with the supply duct 14. This pattern is repeated up to the last distribution pipe 24. Distribution pipe 24 is in communication with the supply ducts 12 and 14.

Figure 3:
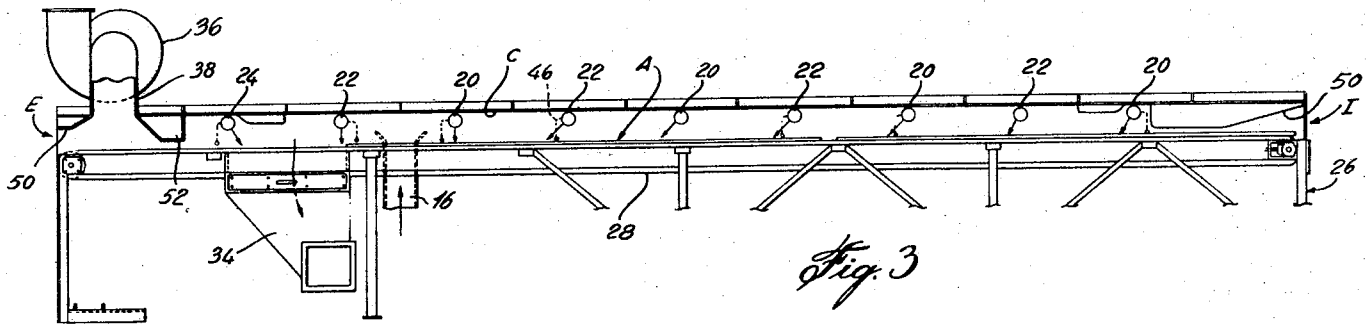
FIG. 3 is a side elevational view, partly in cross-section, of the embodiment shown in FIG. 1, drawn in a larger scale particularly showing the recirculating of vaporous curing agent.

With reference to FIG. 3, the operation of the apparatus is as follows: An article A with a wet resin-coated upper surface is loaded onto the conveyor chains 28 at the inlet I of the apparatus. On reaching the first distribution pipe 20, curing agent is supplied to the upper surface of the article. The curing agent is advanced by the fans 18, on actuation due to appropriate timer controls, not shown, to rise upwardly through the ducts 16 and thence in equal proportions horizontally into the supply ducts 12 and 14, respectively, with the majority of the curing agent flowing towards the inlet end I, i.e., countercurrently with respect to the movement of the article A through the chamber C, and the balance is passed cocurrently towards the exit end E. The curing agent is alternatingly distributed into the distribution pipes 20 and 22 due to the alternating communication pattern described. The curing agent is then expelled through the openings or nozzles 48.

In order to provide for a particularly effective and efficient dispersal of the curing agent onto the wet resin-coated surfaces of the articles A, the nozzles or openings 48 in the distribution pipes are located such that the distribution pipe 24 emits the vaporous curing agent at an angle, preferably at an angle of from about 30° to 45°, from the vertical and downwardly towards the inlet end I. The pipes 22 and 20 provided adjacent the location of the ducts 16 emit the vaporous curing agent in a direction substantially perpendicularly and in a downwardly direction, whereby any excess vaporous curing agent emitted by the distribution pipe 22 is directly removed through the ducts 34. The other distribution pipes 20 and 22 provided in the region towards the inlet end I have nozzles or openings 48 which emit the curing agent downwardly onto an article A passing below at an angle, preferably at an angle of from 30° to 45°, with respect to the vertical axis of a distribution member and in the direction of the exit end E.

It will be appreciated that numerous modifications can be made to the embodiments described in the foregoing. Thus, the distribution pipes can be mounted rotatably to provide for the angular dispersal of the vaporous curing agent.

We claim:

1. An apparatus for curing wet resin coated articles comprising:

a curing chamber, said chamber having a longitudinal direction between inlet and exit openings, said chamber substantially horizontal and hermetically sealed with the exception of said openings;

conveyor means for transporting said articles through said chamber, said conveyor means passing into the inlet opening and out of the exit opening;

at least one supply duct extending parallel to the direction of travel of articles on said conveyor;

a plurality of distribution members, said distribution members extending transversely with respect to the direction of travel of articles on said conveyor means, said distribution members in fluid communication with said supply ducts, said distribution members including a plurality of jet forming nozzles thereon;

vaporous curing agent withdrawal means, associated with said chamber and located between a midpoint of said chamber and said exit opening, for withdrawing a vaporous curing agent from said chamber;

said jet forming nozzles when said supply duct is supplied with a vaporous curing agent, providing a jet of vaporous curing agent forming an acute angle to the vertical, said jet having a component towards said withdrawal means, said nozzles in combination with said vaporous curing agent withdrawal means comprising the sole means for inducing a dynamic flow over the articles to be cured towards said withdrawal means and away from said openings; and means for recirculating the vaporous curing agent passing into said withdrawal means through said supply duct.

2. An apparatus as defined in claim 1, wherein, in addition to said withdrawal means, a further exhaust duct means is provided, adjacent said exit opening, for withdrawing any excess vaporous curing agent escaping said flow towards said withdrawal means.

3. An apparatus as defined in claim 1, wherein said at least one supply duct comprises two supply ducts, located one on either side of said curing chamber, each of said supply ducts is in communication with an alternate one of said plurality of distribution members.

4. An apparatus as defined in claim 1, wherein said articles to be treated are flat panels and said jet forming nozzles are located thereover such that said vaporous curing agent issuing from said nozzles impinges upon said surface of the panel passing therethrough.

5. An apparatus as defined in claim 4, wherein said means for recirculating provides said vaporous curing agent at said jet forming nozzles at a pressure of 2.0 pounds per square inch.

6. Apparatus in accordance with claim 4, wherein said jet forming nozzles are adapted to disperse said curing agent at an angle of from about 30° to 45° with respect to the vertical axis of a distribution member.

* * * * *